United States Patent [19]

Maeda

[11] 4,254,494

[45] Mar. 3, 1981

[54] ACCURACY CORRECTION IN AN ELECTRONIC TIMEPIECE

[75] Inventor: Hidetoshi Maeda, Tenri, Japan

[73] Assignee: Sharp Kabushiki Kaisha, Osaka, Japan

[21] Appl. No.: 888,634

[22] Filed: Mar. 21, 1978

Related U.S. Application Data

[63] Continuation of Ser. No. 653,952, Jan. 30, 1976, abandoned.

[30] Foreign Application Priority Data

Jan. 31, 1975 [JP] Japan ..... 50-13652

[51] Int. Cl.[3] ..... G04C 9/00

[52] U.S. Cl. ..... 368/187; 368/184; 368/185; 368/200; 368/201

[58] Field of Search ..... 73/6; 58/23 R, 85.5, 58/50 R, 23 A; 324/72.5, 79 D, 83 D; 35/30, 31 R, 32; 346/336, 168 R; 368/184, 185, 200, 201

[56] References Cited

U.S. PATENT DOCUMENTS

| | | | |
|---|---|---|---|
| 3,351,493 | 1/1967 | Ingle | 340/336 |
| 3,559,170 | 1/1971 | Barnes | 340/168 R |
| 3,800,233 | 3/1974 | Santhier | 58/23 R X |
| 3,808,407 | 4/1974 | Ratz | 324/79 D X |
| 3,811,314 | 5/1974 | Anouchi | 73/6 |
| 3,852,951 | 12/1974 | Santhier | 58/85.5 X |
| 3,864,957 | 2/1975 | Fujita | 73/6 |
| 3,892,124 | 7/1975 | Reese | 73/6 |
| 3,895,486 | 7/1975 | Hammer et al. | 58/23 R |
| 3,914,931 | 10/1975 | Tsuruishi | 58/23 R |
| 3,931,703 | 1/1976 | Scherrer et al. | 58/85.5 X |
| 3,937,049 | 2/1976 | Murakami et al. | 73/6 |
| 3,946,591 | 3/1976 | Yanagawa et al. | 73/6 |

FOREIGN PATENT DOCUMENTS 1213794 11/1970 United Kingdom ..... 84/454

OTHER PUBLICATIONS

R. Ryan, "Basic Digital Electronics", 1975, pp. 178–183, Tab Books, Blue Ridge Summit, Pa. 17214.

*Primary Examiner*—Ulysses Weldon

*Attorney, Agent, or Firm*—Birch, Stewart, Kolasch and Birch

[57] ABSTRACT

A system for correcting the accuracy of a reference signal in an electronic timepiece comprises an electronic timepiece including a reference signal frequency correction means for increasing or decreasing the reference signal frequency in a digital fashion with the use of a low frequency signal, and a quartz tester arrangement for measuring the accuracy of the reference signal frequency. The quartz tester arrangement indicates the displacement of the reference signal frequency from the standard signal frequency with the use of five lamps, each of which is selected to be enabled in accordance with the detected value of the displacement. The reference signal frequency correction means in the electronic timepiece includes five manually operable switches corresponding to said five lamps and functions to increase or decrease the reference signal frequency in a digital fashion in response to the closing of the switches corresponding to the enabled lamps.

15 Claims, 6 Drawing Figures

(GAIN PULSE GENERATOR -8-)

(LOSE PULSE GENERATOR -9-)

ACCURACY CORRECTION IN AN ELECTRONIC TIMEPIECE

This application is a continuation of copending application Ser. No. 653,952, filed on Jan. 30, 1976 now abandoned.

BACKGROUND OF THE INVENTION

The present invention relates to an accuracy correction system in an electronic timepiece.

In general a quartz oscillator is employed in an electronic timepiece for developing a reference signal of a predetermined frequency, for example, one hertz via an appropriate frequency dividing means. Therefore, the accuracy of the electronic timepiece mainly depends on the precision of the quartz oscillator. However, the natural frequency of the quartz oscillator is unavoidably different from each other due to different manufacturers of the individual quartz oscillators. Moreover, the natural frequency of the quartz oscillator will undergo modification with the lapse of time in an irreversible manner due to on account of the "ageing" and matching between the quartz oscillator and a C-MOS inverter included within the oscillation circuit.

Heretofore, the oscillation frequency of the quartz oscillator has been adjusted through the use of a variable capacitor called a trimmer. The conventional adjustment was achieved in an anologue fashion and was unavoidably complicated.

OBJECTS AND SUMMARY OF THE INVENTION

Accordingly, an object of the present invention is to provide an accuracy correction system for correcting a reference signal frequency in an electronic timepiece in a digital fashion.

Another object of the present invention is to provide an accuracy correction signal input system for introducing a frequency correction signal into a frequency divider included within an electronic timepiece.

Still another object of the present invention is to provide a quartz tester arrangement for indicating a correction value in a form suitable for correcting a reference signal frequency in an electronic timepiece in a digital fashion.

Yet another object of the present invention is to provide a combination for correcting a reference signal frequency in an electronic timepiece, including a quartz tester arrangement for measuring the accuracy of the reference signal frequency and indicating the displacement of the reference signal frequency, and an electronic timepiece comprising a reference signal frequency correction means having an input system corresponding to an indication unit provided at the quartz tester arrangement.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objectives, pursuant to an embodiment of the present invention, a quartz tester arrangement measures the accuracy of the reference signal frequency and indicates the displacement of the reference signal frequency from the standard signal frequency with the use of five lamps, each of which is selected to be enabled in accordance with the detected value of the displacement. A reference signal frequency correction means in an electronic timepiece includes five manually operative switches corresponding to said five lamps and functions to increase or decrease the reference signal frequency in a digital fashion with the use of a low frequency signal, the low frequency signal being generated in response to the closing of the manually operative switches.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

In general a quartz oscillator employed in an electronic timepiece shows deviations of around ±15 PPM due to different makes of individual quartz oscillators, of around ±6 PPM due to the phenomenon of "ageing", and of around ±3 PPM due to the matching between the quartz oscillator and a C-MOS inverter included within the oscillation circuit. Therefore, the maximum value of the deviation caused by the above-mentioned three factors is ±24 PPM. The maximum deviation in a day can be calculated as follows:

$$24\times10^{-6}\times60\times60\times24=2.074 \text{ (seconds/day)}$$

Accordingly, the displacement in a day caused by the deviation of the oscillation frequency usually lies within a range between +2 seconds/day and −2 seconds/day. When the displacement in a range between zero (0) and 2 seconds/day is divided into twelve (12) blocks and correction values are determined for the respective blocks, the deviation after the correction can be reduced to around 0.09 seconds/day as shown in the following TABLE I.

TABLE I

| CORRECTION OF DEVIATION | | |
|---|---|---|
| DEVIATION (SECONDS/DAY) | CORRECTION VALUE (SECONDS/DAY) | DEVIATION AFTER THE CORRECTION (SECONDS/DAY) |
| 0.00~0.10 | NO CORRECTION | 0.00~0.10 |
| 0.11~0.26 | 0.176 ($S_1$) | 0.065~0.084 |
| 0.27~0.44 | 0.352 ($S_2$) | 0.082~0.088 |
| 0.45~0.60 | 0.527 ($S_1 + S_2$) | 0.077~0.073 |

TABLE I-continued

| CORRECTION OF DEVIATION | | |
|---|---|---|
| DEVIATION (SECONDS/DAY) | CORRECTION VALUE (SECONDS/DAY) | DEVIATION AFTER THE CORRECTION (SECONDS/DAY) |
| 0.61~0.78 | 0.703 ($S_3$) | 0.093~0.077 |
| 0.79~0.96 | 0.879 ($S_1 + S_3$) | 0.089~0.081 |
| 0.97~1.14 | 1.055 ($S_2 + S_3$) | 0.085~0.085 |
| 1.15~1.31 | 1.230 ($S_1 + S_2 + S_3$) | 0.080~0.080 |
| 1.32~1.48 | 1.406 ($S_4$) | 0.086~0.074 |
| 1.49~1.67 | 1.582 ($S_1 + S_4$) | 0.092~0.088 |
| 1.68~1.84 | 1.758 ($S_2 + S_4$) | 0.078~0.082 |
| 1.85~2.00 | 1.934 ($S_1 + S_2 + S_4$) | 0.084~0.066 |

It will be clear from TABLE I that, when, for example, the deviation lies within a range between 0.79 seconds/day and 0.96 seconds/day, the correction of 0.879 seconds/day is performed and, therefore, the deviation is reduced to a range between −0.089 seconds/day and +0.081 seconds/day after the correction. When the deviation lies in the first block, namely, between 0.00 seconds/day and 0.10 seconds/day, the correction is not performed because the deviation is so little that the reference frequency is almost accurate.

Figure 1:
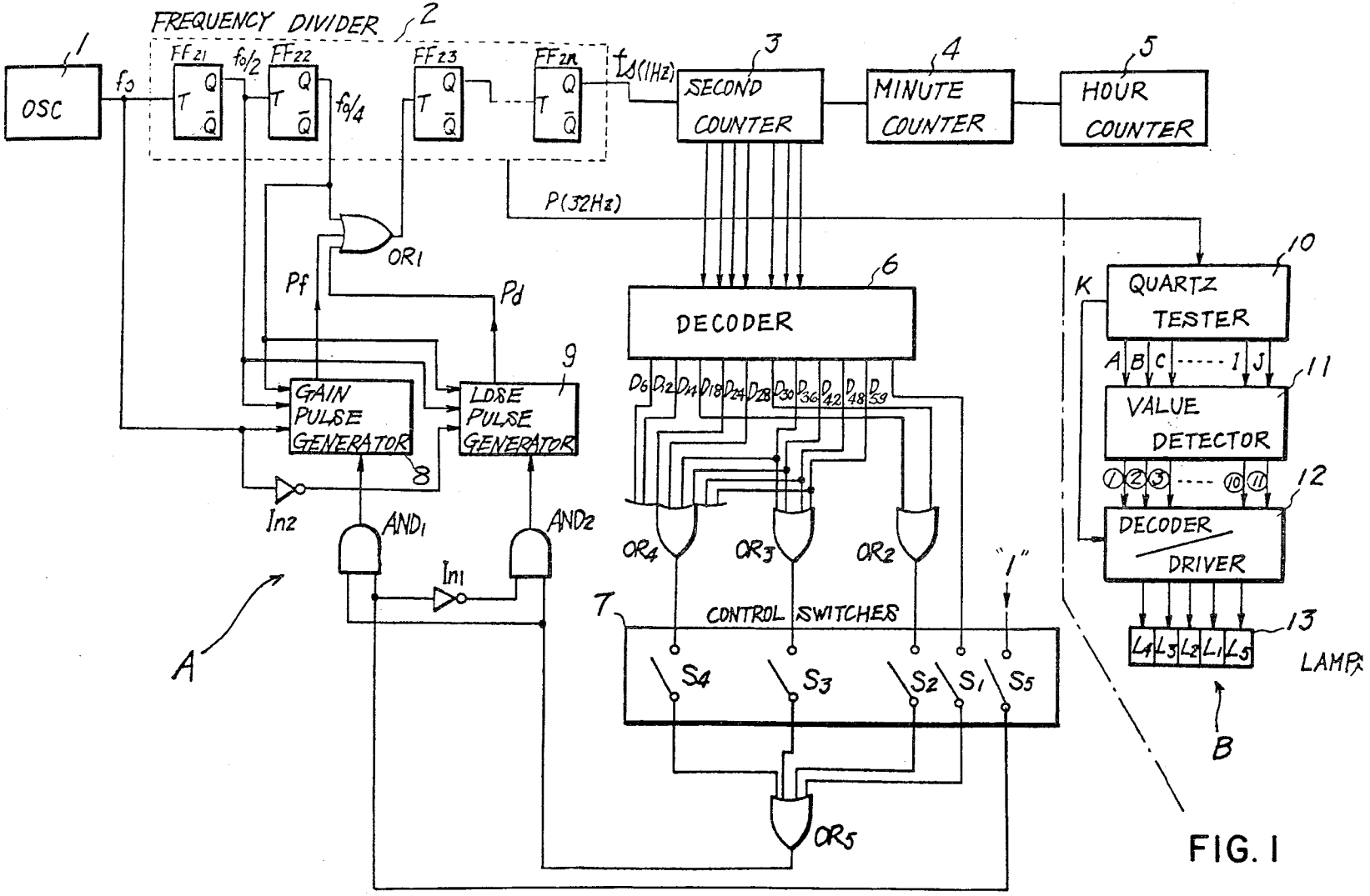
FIG. 1 is a circuit diagram of an embodiment of an accuracy correction system comprising a quartz tester including a value detector, and an electronic timepiece including a gain pulse generator, a lose pulse generator and control switches.

Referring now to FIG. 1, there is illustrated a circuit diagram of an embodiment of an accuracy correction system of the present invention, which comprises an electronic timepiece A and a quartz tester arrangement B.

The electronic timpiece A includes an oscillation circuit 1, a frequency divider 2, a second information counter 3, a minute information counter 4, an hour information counter 5, a suitable display means (not shown), a decoder circuit 6, five (5) manually operable control switches 7, a gain pulse generator 8, a lose pulse generator 9, and several gate means. The quartz tester arrangement B mainly comprises a conventional quartz tester 10. A typical circuit construction of the quartz tester is shown in U.S. Pat. No. 3,238,764 "METHOD FOR MEASURING THE ACCURACY OF TIMEPIECES" invented by Rudolf Greiner and patented on Mar. 8, 1966. In this embodiment the quartz tester 10 is "SHARP QUARTZ METER LX-811" manufactured by SHARP KABUSHIKI KAISHA. The quartz tester arrangement B further includes a deviation value detector 11, five(5) indication lamps 13, and a decoder/driver circuit 12 for enabling the lamps 13.

The oscillation circuit 1 includes a quartz osillator and generates a base signal $f_0$ of 32,768 hertz. The frequency divider 2 comprises a chain of T-type flip-flops $FF_{21}$, $FF_{22}$, $FF_{23}$, - - - , and $FF_{2n}$ and develops a reference signal $f_s$ of one hertz. An OR gate $OR_1$ is disposed between the second T-type flip-flop $FF_{22}$ and the third T-type flip-flop $FF_{23}$ is connected to receive not only an output signal $f_o/4$ of the second T-type flip-flop $FF_{22}$ but also a gain pulse $p_f$ and a lose pulse $P_d$, which will be described later. The reference signal $f_s$ of one hertz is sequentially introduced into the second information counter 3, the minute information counter 4 and the hour information counter 5. The time information stored in the respective counters is displayed on a display unit via suitable decoder/driver circuits. The display unit and the decoder/driver circuits can be of any construction known in the art and since the specific details thereof do not constitute a part of the present invention they have been omitted from the drawing for the purposes of simplicity.

The quartz tester 10 included within the quartz tester arrangement B can measure the accuracy of the electronic timepiece A in the order of 1/100 seconds/day. When the electronic timepiece A is set on an appropriate place of the quartz tester arrangement B, the quartz tester 10 picks up a signal P of around 32 hertz from the frequency divider 2 included within the electronic timepiece A in order to develop signals A, B, C, - - - , and J in a binary-coded decimal notation in accordance with the measurement of the accuracy of the electronic timepiece A. The signals A (1), B (2), C (4) and D (8), in combination, represent the deviation in the order of 0.1 seconds/day, the signals E (1), F (2), G (4) and H (8), in combination, represent the deviation in the order of 0.01 seconds/day, and the signals I (1) and J (2), in combination, represent the deviation in the order of $10^0$ seconds/day. An additional output signal K bears the logical value "1" when the deviation takes a nagative value, whereas the output signal K bears the logical value "0" when the deviation takes a positive value.

The deviation value detector 11 receives the output signals of the quartz tester 10 in the binary-coded decimal notation to develop signals ①, ②, - - - , and ⑪ in accordance with the following TABLE II.

TABLE II

| DETECTION LOGIC OF THE DEVIATION VALUE DETECTOR - 11 - | |
|---|---|
| DEVIATION (SECONDS/DAY) | DETECTION LOGIC |
| 0.11~0.26 | ① = $[A\overline{BCD}(E+F+G+H) + \overline{A}B\overline{CD}(\overline{H+EG})]\,\overline{I}\,\overline{J}$ |
| 0.27~0.44 | ② = $[\overline{A}B\overline{CD}(H+EG) + AB\overline{CD} + \overline{A}\,\overline{B}CD(\overline{GH+EFG})]\,\overline{I}\,\overline{J}$ |
| 0.45~0.60 | ③ = $[\overline{A}\,\overline{B}CD(\overline{GH+EFG}) + A\overline{B}C\overline{D} + \overline{A}BC\overline{D}(\overline{E+F+G+H})]\,\overline{I}\,\overline{J}$ |
| 0.61~0.78 | ④ = $[\overline{A}BC\overline{D}(E+F+G+H) + ABC\overline{D}(\overline{H+E})]\,\overline{I}\,\overline{J}$ |
| 0.79~0.96 | ⑤ = $[ABC\overline{D}(\overline{H+E}) + \overline{A}\,\overline{B}\,\overline{C}D + A\overline{B}\,\overline{C}D(\overline{H+EFG})]\,\overline{I}\,\overline{J}$ |
| 0.97~1.14 | ⑥ = $A\overline{B}\,\overline{C}D(H+EFG)\,\overline{I}\,\overline{J} + [\overline{A}\,\overline{B}\,\overline{C}D + A\overline{B}\,\overline{C}D(\overline{H+FG+EG})]\,I\,\overline{J}$ |
| 1.15~1.31 | ⑦ = $[A\overline{B}\,\overline{C}D(H+FG+EG) + \overline{A}B\overline{C}D + AB\overline{C}D(\overline{F+G+H})]\,I\,\overline{J}$ |
| 1.32 ~1.48 | ⑨ = $[AB\overline{C}D(F+G+H) + \overline{A}\,\overline{B}C\overline{D}(\overline{E+H})]\,I\,\overline{J}$ |
| 1.49~1.67 | ⑨ = $[\overline{A}\,\overline{B}C\overline{D}(\overline{E+H}) + A\overline{B}C\overline{D} + \overline{A}BC\overline{D}H]\,I\,\overline{J}$ |
| 1.68~1.84 | ⑩ = $[\overline{A}BC\overline{D}H + ABC\overline{D} + \overline{A}\,\overline{B}\,\overline{C}D(\overline{H+FG+EG})]\,I\,\overline{J}$ |

TABLE II-continued

| DETECTION LOGIC OF THE DEVIATION VALUE DETECTOR - 11 - | |
|---|---|
| DEVIATION (SECONDS/DAY) | DETECTION LOGIC |
| 1.85~2.00 | ⑪ = $[\overline{ABCD}(H + FG + EG) + A\overline{BCD}]I\bar{J} + \bar{I}J$ |

When, for example, the measured deviation lies in a range between 0.11 seconds/day and 0.26 seconds/day, only the signal ① bears the logical value "1". When the measured deviation lies in a range between 0.27 seconds/day and 0.44 seconds/day, only the signal ② bears the logical value "1". In the same manner, only the signal ⑪ takes the logical value "1" when the measured deviation is in a range between 1.85 seconds/day and 2.00 seconds/day. When the measured deviation is in a range between 0.00 seconds/day and 0.10 seconds/day, no signals take the logical value "1".

The decoder/driver circuit 12 receives the signals ① through ⑪ to convert them into binary signals in accordance with the signal number bearing the logical value "1", whereby activating lamps $L_1$, $L_2$, $L_3$ and $L_4$ in the binary notation. That is, the lamps $L_1$, $L_2$, $L_3$ and $L_4$ correspond to the decimal number one (1), two (2), four (4) and eight (8), respectively. When, for example, the signal ③ from the deviation value detector 11 takes the logical value "1", the lamps $L_1$ and $L_2$ are enabled. The decoder/driver circuit 12 also receives the output signal K of the quartz tester 10, thereby to enable a lamp $L_5$ when the output signal K bears the logical value "1" to indicate that the deviation takes a negative value.

When one (1) pulse is added to or subtracted from the output signal $f_o/4$ of the second T-type flip-flop $FF_{22}$ every one minute by controlling the input signal of the third T-type flip-flop $FF_{23}$ every one minute, the accuracy of the electronic timepiece A will be corrected by 0.176 seconds in a day because the output signal $f_o/4$ has a frequency of 32,768/4 hertz and;

$$(1/60\times60\times60\times24)/(32768/4)=0.176 \text{ (seconds/day)}$$

When two (2) pulses are added to or subtracted from the signal $f_o/4$ every one minute, the correction of 0.352 seconds/day will be effected. The accuracy of the electronic timepiece will be corrected by 1.934 seconds/day by adding or subtracting eleven (11) pulses to or from the signal $f_o/4$ every one minute.

The second information stored in the second information counter 3, namely, BCD (binary-coded decimal) output signals as to seconds and ten seconds are introduced into the decoder circuit 6, which develops signals $D_6$, $D_{12}$, $D_{14}$, $D_{18}$, $D_{24}$, $D_{28}$, $D_{30}$, $D_{36}$, $D_{42}$, $D_{48}$ and $D_{59}$ which take the logical value "1" when the contents of the second information counter 3 are six (6), twelve (12), fourteen (14), twenty-four (24), twenty-eight (28), thirty (30), thirty-six (36), fourty-two (42), fourty-eight (48), and fifty-nine (59), respectively. The signal $D_{59}$ is applied to one terminal of a switch $S_1$ within the control switches 7. The signals $D_{14}$ and $D_{28}$ are applied to one terminal of a switch $S_2$ of the control switches 7 via an OR gate $OR_2$. The signals $D_{30}$, $D_{36}$, $D_{42}$ and $D_{48}$ are conducted to one terminal of a switch $S_3$ included within the control switches 7 through an OR gate $OR_3$. The signals $D_{30}$, $D_{36}$, $D_{42}$ and $D_{48}$ are also conducted to one terminal of a switch $S_4$ in unison with the signals $D_6$, $D_{12}$, $D_{18}$ and $D_{24}$ via an OR gate $OR_4$. When the control switches $S_1$, $S_2$, $S_3$ and/or $S_4$ are closed, the signals conducted to the respective switches are applied to an AND gate $AND_1$ and another AND gate $AND_2$ via an OR gate $OR_5$. One (1) signal is applied to the OR gate $OR_5$ when the switch $S_1$ is closed. Two (2) signals are applied to the OR gate $OR_5$ when the switch $S_2$ is switched on. Four (4) signals are supplied to the OR gate $OR_5$ when the switch $S_3$ is turned on. Eight (8) signals are applied to the OR gate $OR_5$ when the switch $S_4$ is closed. Accordingly, the number of signals to be applied to the AND gates $AND_1$ and $AND_2$ via the OR gate $OR_5$ can be desirably selected up to eleven (11) in a binary fashion because the switches $S_1$, $S_2$, $S_3$ and $S_4$ correspond to the decimal numbers one (1), two (2), four (4) and eight (8), respectively. One terminal of a switch $S_5$ included within the control switches 7 is always supplied with a signal taking the logical value "1". The other terminal of the switch $S_5$ is connected to the AND gate $AND_1$ and to the AND gate $AND_2$ via an inverter $In_1$, whereby the AND gate $AND_1$ is set ON when the switch $S_5$ is closed and the AND gate $AND_2$ is set ON when the switch $S_5$ is switched off.

An output signal of the AND gate $AND_1$ is applied to the gain pulse generator 8 for developing the gain pulse $P_f$, whereas an output signal of the AND gate $AND_2$ is applied to the lose pulse generator 9 for developing the lose pulse $P_d$. The gain pulse generator 8 is connected to receive the base signal $f_o$ and the output signals $f_o/2$ and $f_o/4$ from the first and second T-type flip-flops $FF_{21}$ and $FF_{22}$ included within the frequency divider 2 as clock pulses. The lose pulse generator 9 is connected to receive the inverted base signal $\overline{f_o}$ via an inverter $In_2$ and the output signals $f_o/2$ and $f_o/4$ as clock pulses.

Figure 2:
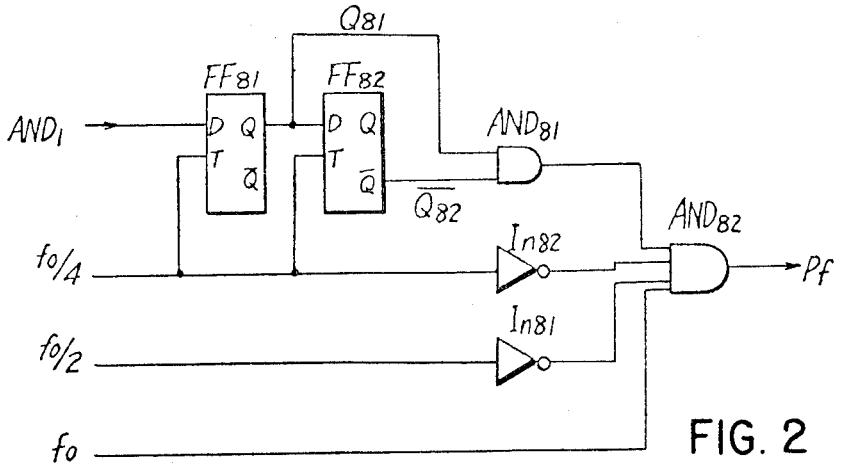
FIG. 2 is a circuit diagram of an embodiment of the gain pulse generator shown in FIG. 1.

A typical circuit construction of the gain pulse generator 8 is shown in FIG. 2. The operation mode of the gain pulse generator 8 will be described with reference to the FIG. 3 time chart.

Figure 3:
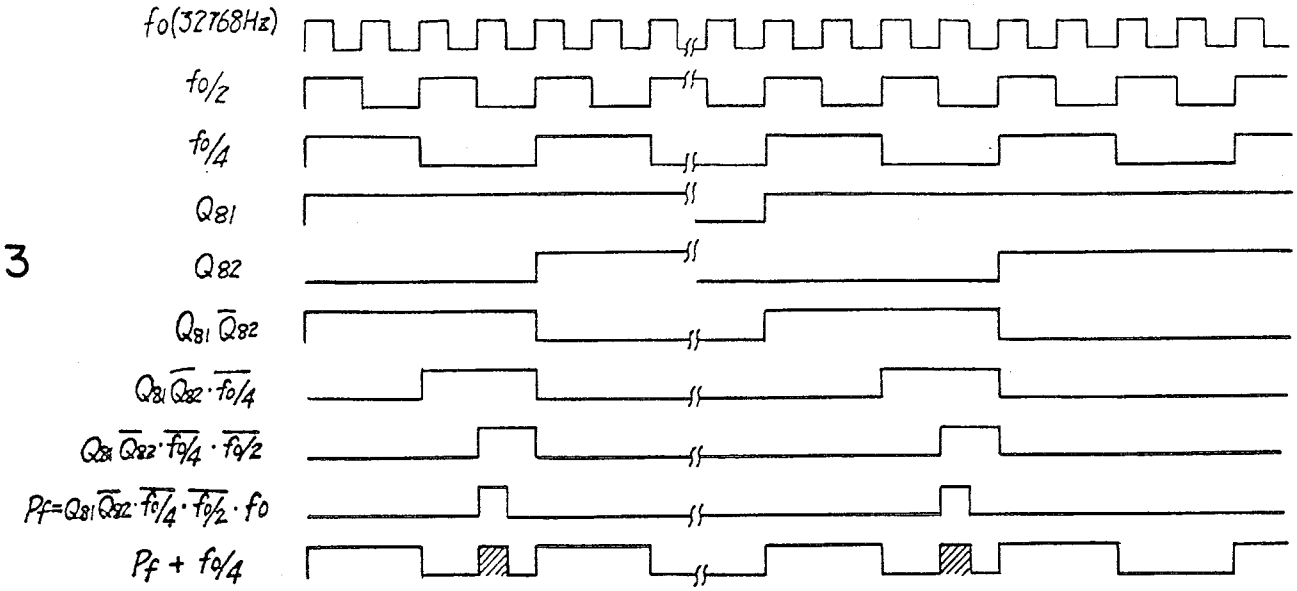
FIG. 3 is a time chart showing various signals occurring within the gain pulse generator of FIG. 2.

When a signal bearing the logic value "1" is applied to the D terminal of a D-type flip-flop $FF_{81}$ from the AND gate $AND_1$, the Q output of the D-type flip-flop $FF_{81}$ takes the logic value "1" upon occurrence of the first leading edge of the output signal $f_o/4$ as shown in FIG. 3 $Q_{81}$. The Q output signal of a D-type flip-flop $FF_{82}$ bears the logic value "1" upon occurrence of the following leading edge of the output signal $f_o/4$ as shown in FIG. 3 $Q_{82}$. An AND gate $AND_{81}$ receives the Q output signal $Q_{81}$ of the D-type flip-flop $FF_{81}$ and the $\overline{Q}$ output signal $\overline{Q}_{82}$ of the D-type flip-flop $FF_{82}$, and applies the output signal $Q_{81}\cdot\overline{Q}_{82}$ thereof to an AND gate $AND_{82}$. The AND gate $AND_{82}$ is connected to receive the output signal $Q_{81}\cdot\overline{Q}_{82}$, the base signal $f_o$, an inverted signal $\overline{f_o/2}$ of the output signal $f_o/2$ via an inverter $In_{81}$, and an inverted signal $\overline{f_o/4}$ of the output signal $f_o/4$ via an inverter $In_{82}$, thereby to develop an output signal $Q_{81}\cdot\overline{Q}_{82}\cdot\overline{f_o/4}\cdot\overline{f_o/2}\cdot f_o$, which acts as the gain pulse $P_f$. Therefore, the gain pulse $P_f$ has a pulse width identical with a half period of the base signal $f_o$ and assumes the logic value "1" when the output signal $f_o/4$ bears the logic value "0".

When the gain pulse $P_f$ is added to the output signal $f_o/4$ of the second T-type flip-flop $FF_{22}$ by the OR gate $OR_1$, the pulse number of the signal $f_o/4$ increases by one. The adding operation is performed at every time when the D terminal of the D-type flip-flop $FF_{81}$ receives the signal of the logic value "1". The electronic timepiece A becomes fast by 0.176 seconds in a day when one (1) pulse is added to the output signal $f_o/4$ every one minute. The electronic timepiece A becomes fast by 0.352 seconds in a day when two (2) pulses are added to the output signal $f_o/4$ every one minute. In the same way, the electronic timepiece A becomes fast by 1.934 seconds in a day by adding eleven (11) pulses to the output signal $f_o/4$ in one minute.

Figure 4:
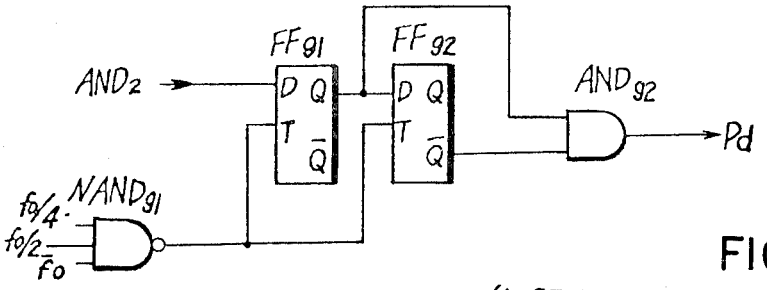
FIG. 4 is a circuit diagram of an embodiment of the lose pulse generator shown in FIG. 1.

A typical circuit construction of the lose pulse generator 9 is shown in FIG. 4, of which the operation mode will be described with reference to the FIG. 5 time chart.

A NAND gate $NAND_{91}$ is connected to receive an inverted signal $\overline{f_o}$ of the base signal $f_o$ generated from the oscillation circuit 1, the output signal $f_o/2$ of the first flip-flop $FF_{21}$ included within the frequency divider 2 and the output signal $f_o/4$ of the second flip-flop $FF_{22}$ included within the frequency divider 2, thereby to develop an output signal $\overline{f_o \cdot (f_o/2) \cdot (f_o/4)}$. When the D terminal of a D-type flip-flop $FF_{91}$ receives a signal bearing the logic value "1" from the AND gate $AND_2$, the Q output $Q_{91}$ of the D-type flip-flop $FF_{91}$ takes the logic value "1" upon first occurrence of the leading edge of the output signal of the NAND gate $NAND_{91}$ as shown in FIG. 5 $Q_{91}$.

Figure 5:
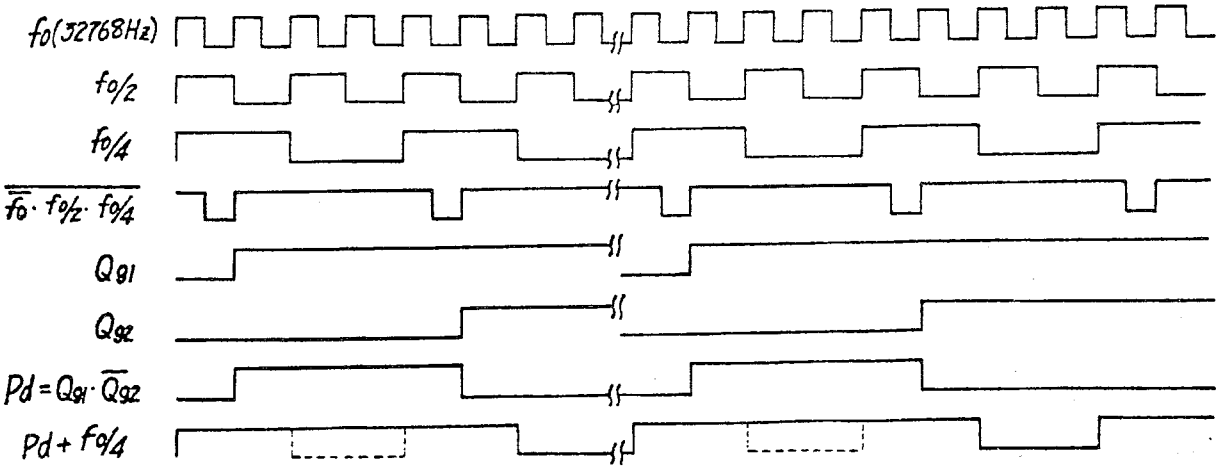
FIG. 5 is a time chart showing various signals occurring within the lose pulse generator of FIG. 4.

A Q output signal $Q_{92}$ of a following D-type flip-flop $FF_{92}$ bears the logic value "1" upon occurrence of the following leading edge of the output signal of the NAND gate $NAND_{91}$ (see FIG. 5 $Q_{92}$). An AND gate $AND_{92}$ is connected to receive the Q output signal of the flip-flop $FF_{91}$ and the Q output signal of the flip-flop $FF_{92}$ in order to develop an output signal $Q_{91} \cdot \overline{Q}_{92}$ as the lose pulse $P_d$. Therefore, the lose pulse $P_d$ has a pulse width identical with one period of the output signal $f_o/4$ and is positioned in such a manner to have the logic value "1" when the output signal $f_o/4$ assumes the logic value "0" between the two adjacent portions of the logic value "1".

When the lose pulse $P_d$ is added to the output signal $f_o/4$ of the second T-type flip-flop $FF_{22}$ by the OR gate $OR_1$, the pulse number of the output signal $f_o/4$ is decreased by one as will be clear from the FIG. 5 time chart. The decrement operation is performed at every time when the D terminal of the D-type flip-flop $FF_{91}$ receives the signal taking the logic value "1". When one (1) pulse is reduced from the output signal $f_o/4$ every one minute, the electronic timepiece A becomes slow by 0.176 seconds in a day. The electronic timepiece A becomes slow by 0.352 seconds in a day when the pulse number of the output signal $f_o/4$ is decreased by two (2) in one minute. In the same manner, when eleven (11) pulses are removed from the output signal $f_o/4$ in one minute, the electronic timepiece A loses 1.943 seconds in a day.

The pulse number to be added to or substracted from the output signal $f_o/4$ in every one minute is selectively determined through the use of the switches $S_1$, $S_2$, $S_3$ and $S_4$ included within the control switches 7. The pulse number is represented in a binary fashion. The switch $S_5$ functions to determine whether the pulses should be added or subtracted. It will be clear that the indication lamps 13 included within the quartz tester arrangement B correspond to the control switches 7 included within the electronic timepiece A. More particularly, the switches $S_1$, $S_2$, $S_3$, $S_4$ and $S_5$ correspond to the lamps $L_1$, $L_2$, $L_3$, $L_4$ and $L_5$, respectively. Therefore, a suitable correction value can be selected through the use of the control switches 7 by closing the switches $S_1$ through $S_5$ corresponding to the enabled lamps $L_1$ through $L_5$.

When, for example, the electronic timepiece A set on the quartz tester arrangement B has the deviation −1.85 seconds/day, the quartz tester 10 detects the deviation −1.85 seconds/day and the output signal ⑪ of the deviation value detector 11 takes the logical value "1" as will be clear from the TABLE II. The lamps $L_1$, $L_2$ and $L_4$ in the indication lamps 13 are enabled because [1+2+8=11]. The lamp $L_5$ is also enabled since the deviation takes the negative value and the signal K bears the logic value "1". When the switches $S_1$, $S_2$, $S_4$ and $S_5$ corresponding to the lamps $L_1$, $L_2$, $L_4$ and $L_5$ are closed, the detector output signals $D_{59}$, $D_{14}$, $D_{28}$, $D_6$, $D_{12}$, $D_{18}$, $D_{24}$, $D_{30}$, $D_{36}$, $D_{42}$ and $D_{48}$ are applied to the OR gate $OR_5$ through the switches $S_1$, $S_2$ and $S_4$. These decoder output signals are applied to the gain pulse generator 8 via the AND gate $AND_1$ since the switch $S_5$ is closed. The gain pulse generator 8 receives eleven (11) pulses in every one minute, whereby eleven (11) pulses are added to the output signal $f_o/4$ of the second T-type flip-flop $FF_{22}$ in the frequency divider 2 in every one minute. In this manner the electronic timepiece A is made faster by 1.943 seconds in a day. The correction value actually made corresponds to the correction value shown in the TABLE I in the region of the deviation between 1.85 seconds/day and 2.00 seconds/day.

When the electronic timepiece A has the deviation +0.40 seconds/day, the output signal ② of the deviation value detector 11 takes the logic value "1", and hence only the lamp $L_2$ is enabled. When the switch $S_2$ corresponding to the lamp $L_2$ is closed, the decoder output signals $D_{14}$ and $D_{28}$ are applied to the lose pulse generator 9 via the OR gate $OR_5$ and the AND gate $AND_2$. The lose pulse generator 9 receives two (2) pulses in every one minute, whereby two (2) pulses are subtracted from the output signal $f_o/4$ in very one minute. In this manner the electronic timepiece A becomes slow by 0.352 seconds in a day.

Figure 6:
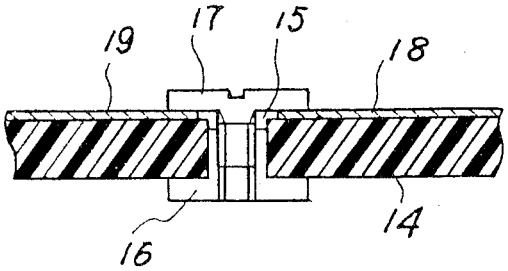
FIG. 6 is a cross-sectional view of an embodiment of a control switch shown in FIG. 1.

FIG. 6 shows a typical construction of the control switches 7. In FIG. 6, only one switch is illustrated for the purpose of simplicity.

Wiring patterns 18 and 19 are formed on a circuit board 14 included within the electronic timepiece A such as an electronic wristwatch.

A block 16 having a tapped hole is installed through a hole 15, the tapped hole having a screw 17 therein. When the screw 17 is installed through the tapped hole, the screw head functions to connect the wiring patterns 18 and 19 with each other. When the wiring patterns 18 and 19 are connected with each other, the switch corresponding to the screw 17 is in its closed condition. The installation of the screw 17 is performed at the desired points corresponding to the enabled lamps 13 by opening the rear cover of the electronic wristwatch. Needless to say, five (5) screw portions are formed in such a manner to practice the circuit shown in FIG. 1.

The invention being thus described, it will be obvious that the same may be varied in many ways. Such variations are not to be regarded as a departure from the spirit and scope of the invention, and all such modifications are intended to be included within the scope of the following claims.

What is claimed is:

1. In a system for correcting the accuracy of an electronic timepiece including a quartz oscillator means for generating a reference signal frequency subject to deviations in magnitude above and below a predetermined frequency, tester means for measuring the deviation of said reference signal frequency from said predetermined frequency, the improvement comprising:

means for classifying said deviation into at least three groups of predetermined ranges of said magnitude;

indicator means including a plurality of indicators forming an ON-OFF display pattern of the classified deviation as a binary number;

reference signal frequency correction means including a plurality of manually operable switches in one-to-one correspondence with said plurality of indicators for generating a correction signal in binary form corresponding to the binary number displayed by said indicator means by actuating said switches in direct correspondence to the ON-OFF display pattern of said indicators; and circuit means for coupling said reference signal frequency correction means to said timepiece.

2. The system of claim 1, wherein said indicator means comprises a row of five lamps selectively energized by said classifying means for forming said ON-OFF display pattern.

3. The system of claim 2, wherein the ON-OFF condition of four of the five lamps indicates said binary number and the ON-OFF condition of the remaining lamp indicates whether said classified deviation is above or below said predetermined frequency.

4. The system of claim 1, wherein said means for classifying classifies said deviations into twelve groups of time intervals in units of seconds per day and the sum of said time intervals equals approximately two seconds per day and further including means for generating a predetermined correction value for each of said groups, said correction value being displayed in binary form on said display means.

5. The system set forth in claim 1 wherein the electronic timepiece comprises:

the quartz oscillator;

a frequency divider for dividing output signals of the quartz oscillator and developing a reference signal of one hertz;

time information counting means for storing the time information by receiving the reference signal from the frequency divider;

a reference signal frequency correction means for varying the reference signal frequency by adding or subtracting low frequency pulses to or from a high frequency signal occurring within the frequency divider; and a switch means for selectively setting the frequency of the low frequency pulses to be added to or subtracted from the high frequency signal occurring within the frequency divider.

6. The system of claim 5, wherein the frequency divider comprises a chain of T-type flip-flops.

7. The system of claim 6, wherein the low frequency pulses are added to or subtracted from an output signal of the second T-type flip-flop included within the frequency divider.

8. The system of claim 5 wherein the reference signal frequency correction means comprises:

a gain pulse generator for developing a desired number of low frequency pulses to be added to the high frequency signal occurring within the frequency divider; and a lose pulse generator for developing a desired number of low frequency pulses to be subtracted from the high frequency signal occurring within the frequency divider.

9. The system of claim 5, wherein the quartz oscillator generates a base signal of 32,768 hertz.

10. In a system for correcting the accuracy of an electronic timepiece including a quartz oscillator, means for generating a reference signal frequency subject to deviations above and below a predetermined frequency, tester means for measuring the deviation of said reference signal frequency from said predetermined frequency, the improvement comprising:

indicator means including a plurality of indicators forming an ON-OFF display pattern of the deviation as a binary number;

reference signal frequency correction means including a plurality of manually operable switches in one-to-one correspondence with said plurality of indicators for generating a correction signal in binary form corresponding to the binary number displayed by said indicator means by actuating said switches in direct correspondence to the ON-OFF display pattern of said indicators; and circuit means for coupling said reference signal frequency correction means to said timepiece.

11. A frequency tester for measuring and correcting the accuracy of a reference signal frequency generated by a reference signal source as compared to a predetermined frequency, said reference signal frequency being subject to deviations from said predetermined frequency, comprising:

means for classifying said deviation into at least three groups of predetermined ranges of magnitudes above or below said predetermined frequency;

indicator means including a plurality of indicators forming an ON-OFF display pattern of the classified deviation as a binary number;

reference signal frequency correction means including a plurality of manually operable switches in one-to-one correspondence with said plurality of indicators for generating a correction signal in binary form corresponding to the binary number displayed by said indicator means by actuating said switches in direct correspondence to the ON-OFF display pattern of said indicators; and circuit means for coupling said reference signal frequency correction means to said reference signal source.

12. The system of claim 11, wherein said means for classifying classifies said deviations into twelve groups of time intervals in units of seconds per day and the sum of said time intervals equals approximately two seconds per day and further including means for generating a predetermined correction value for each of said groups, said correction value being displayed in binary form on said display means.

13. The system of claim 11, wherein said indicator means comprises a row of five lamps selectively energized by said classifying means for forming said ON-OFF display pattern.

14. The system of claim 13, wherein the ON-OFF condition of four of the five lamps indicates said binary number and the ON-OFF condition of the remaining lamp indicates whether said classified deviation is above or below said predetermined frequency.

15. A frequency tester for measuring and correcting the accuracy of a reference signal frequency generated by a reference signal source as compared to a predetermined frequency, said reference signal frequency being subject to deviation from said predetermined frequency, comprising:

indicator means including a plurality of indicators forming an ON-OFF display pattern of the deviation as a binary number;

reference signal frequency correction means including a plurality of manually operable switches in one-to-one correspondence with said plurality of indicators for generating a correction signal in binary form corresponding to the binary number displayed by said indicator means by actuating said switches in direct correspondence to the ON-OFF display pattern of said indicators; and circuit means for coupling said reference signal frequency correction means to said reference signal source.

* * * * *